US007416100B2

(12) United States Patent
Fielitz

(10) Patent No.: US 7,416,100 B2
(45) Date of Patent: Aug. 26, 2008

(54) SETTING TOOL

(75) Inventor: Harald Fielitz, Buchs (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 11/657,782

(22) Filed: Jan. 24, 2007

(65) Prior Publication Data

US 2007/0187449 A1 Aug. 16, 2007

(30) Foreign Application Priority Data

Feb. 14, 2006 (DE) ..... 10 2006 000 064

(51) Int. Cl.
*B21J 15/28* (2006.01)

(52) U.S. Cl. ..... 227/8; 227/10; 227/120; 227/126; 227/135; 227/136

(58) Field of Classification Search ..... 227/8–10, 227/120, 126, 135–136; 89/1.14
See application file for complete search history.

(56) References Cited

U.S. PATENT DOCUMENTS 4,197,974 A * 4/1980 Morton et al. ..... 227/8
4,200,216 A * 4/1980 Maier ..... 227/136
4,201,324 A * 5/1980 Maier et al. ..... 227/9
4,404,877 A * 9/1983 Mizuno et al. ..... 81/57.37
4,930,673 A * 6/1990 Pfister ..... 227/10
5,167,359 A * 12/1992 Frommelt ..... 227/8
5,597,972 A * 1/1997 Wachter ..... 89/1.14
5,829,661 A * 11/1998 Hirtl et al. ..... 227/10
5,975,399 A * 11/1999 Oehri et al. ..... 227/120
6,378,752 B1 * 4/2002 Gaudron ..... 227/10
6,994,240 B2 * 2/2006 Jakob et al. ..... 227/8
7,111,767 B2 * 9/2006 Losada ..... 227/119
7,143,919 B2 * 12/2006 Weibel et al. ..... 227/10

FOREIGN PATENT DOCUMENTS

DE 4032200 A1 4/1992
DE 19642295 A1 4/1998

* cited by examiner

*Primary Examiner*—Brian D. Nash
*Assistant Examiner*—Michelle Lopez
(74) *Attorney, Agent, or Firm*—Abelman, Frayne & Schwab

(57) ABSTRACT

A hand-held setting tool for driving fastening elements in a workpiece includes a muzzle member (20) axially displaceable relative to the tool housing (11) in a direction of an operational axis (A) of the setting tool (10), a feeding channel (28) for a fastening element strip (50) and arranged in the muzzle member (20) and opening into a fastening element the receiving chamber (29) provided in the muzzle member (20), and a locking member (40) arranged on the muzzle member (20) and forming a locking section (42) displaceable into the feeding channel (28), and a blocking section (41) for preventing displacement of the muzzle member relative to the housing.

14 Claims, 5 Drawing Sheets

SETTING TOOL

BACKGROUND OF THE INVENTION

1. Field of the Invention

The present invention relates to a hand-held setting tool for driving fastening elements in a workpiece and including a housing, a muzzle member axially displaceable relative to the housing in a direction of an operational axis of the setting tool and having a chamber for receiving a fastening element, a feeding channel for a fastening element strip and arranged in the muzzle member and opening into the receiving chamber, and a locking member arranged on the muzzle member and forming a locking section displaceable into the feeding channel.

2. Description of the Prior Art

Setting tools of the type discussed above can be driven with solid, gaseous, or liquid fuels, or with compressed air. In combustion-powered tools, a setting piston is driven by high-pressure combustion gases. The setting piston drives a fastening element in a workpiece.

German Patent DE 40 32 200 C2 discloses a setting tool in which a muzzle member, which has a receiving chamber for a fastening element driven in a workpiece, is axially displaceable relative to the tool housing. On the setting tool, there is provided a press-on feeler that initials a drive-in process upon its displacement relative to the muzzle part when the setting tool is pressed against the workpiece.

The setting tool further includes a blocking member that blocks the relative displacement of the feeler when no fastening element is located in the receiving chamber of the muzzle member. A drive-in or setting process with the setting tool then cannot be carried out.

German Publication DE 196 42 295 A1 discloses a hand-held, explosive power charge-operated setting tool in which a bolt guide, which is formed as a muzzle member, forms a guide channel for fastening elements. The muzzle member is axially displaceable relative to the housing. On the muzzle member, there is provided a pivotal lever that lockingly pivots in the projection of the cross-section of the guide channel by a control element upon displacement of the muzzle member relative to the housing.

The drawback of both above-discussed known setting tools consists, among others, in a large number of components.

Accordingly, an object of the present invention is a setting tool of the above-discussed type and having as few components as possible.

Another object of the present invention is a setting tool of the type discussed above that would insure a reliable detection of a fastening element strip and that would prevent displacement of the fastening element strip in the press-on condition of the setting tool.

SUMMARY OF THE INVENTION

These and other objects of the present invention, which will become apparent hereinafter, are achieved by providing a setting tool of the type discussed above in which the locking member forms, in addition to the locking section, also a blocking section for preventing displacement of the muzzle member relative to the housing.

The locking element according to the present invention, thus, in addition to the function of blocking displacement of a fastening element strip in a displacement hold-up position, performs a function of blocking axial displacement of the muzzle member relative to the housing in the press-on position of the setting tool when there is no fastening element in the guide channel or in the receiving chamber of the muzzle member, or when the fastening element is not located in its predetermined position. As a result, additional components for blocking the press-on function can be dispensed with.

Advantageously, the setting tool includes a press-on feeler axially displaceable in a guide space provided in the muzzle member and a spring for resiliently biasing the press-on feeler in a direction of its release or initial position. The blocking section of the locking member is lockingly displaceable in the guide space for the press-on feeler.

By blocking the press-on feeler, in a simple way, pressing of the setting tool against a workpiece or a constructional component and, thereby, an actuation of the setting tool can be prevented when no fastening element is located in the feeding channel or in the receiving space of the muzzle member.

Advantageously, there is provided, on the feeler, a locking profile that insures blocking of the locking member. The locking profile on the feeler provides for locking of the locking member in the displacement hold-up position without use of additional components when the setting tool is pressed against a workpiece. This insures reliable functioning of the locking member.

According to an advantageous space-saving embodiment of the locking member, the blocking section of the locking member is formed on a side of the locking member remote form the feeding channel.

Advantageously, the setting tool has spring means for elastically biasing the locking member in a direction of an engagement position of the locking section in the feeding channel (displacement hold-up position). In this way, for displacement of the locking member into its displacement hold-up position, the locking member should be only secured against an inadvertent pivotal movement out of the feeding channel, while the pivotal movement of the locking member into the feeding channel is effected automatically by spring means already before a press-on step.

Advantageously, there is provided in the setting tool, a fastening element magazine projecting from the muzzle member in the direction of the feeding channel and from which the fastening element strip is fed into the feeding channel. The fastening element magazine has an elastically biased, displaceable transportation slide. The transportation slide has an adjusting profile that is brought in abutment with a counter-profile on the locking member for displacing the locking member in a position in which the locking member prevents the displacement of the muzzle member relative to the housing when no fastening element strip is located in the feeding channel. In this way, control of the locking element for detection of an empty fastening element strip can be effected in a simple manner by the transportation slide. Detection means for the receiving chamber of the muzzle member can, thus, be eliminated.

It is advantageous when a support profile for the fastening element strip and which projects into the feeding channel, is provided on a side of the feeding channel opposite the locking section of the locking member. The support profile prevents a sidewise displacement of the fastening element strip when the displacement of the strip forward is blocked by the locking section of the locking member.

It is kinematically advantageous when the locking member is formed as a pivotal lever. Thereby, only small displacement forces for changing the position of the locking member are necessary.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
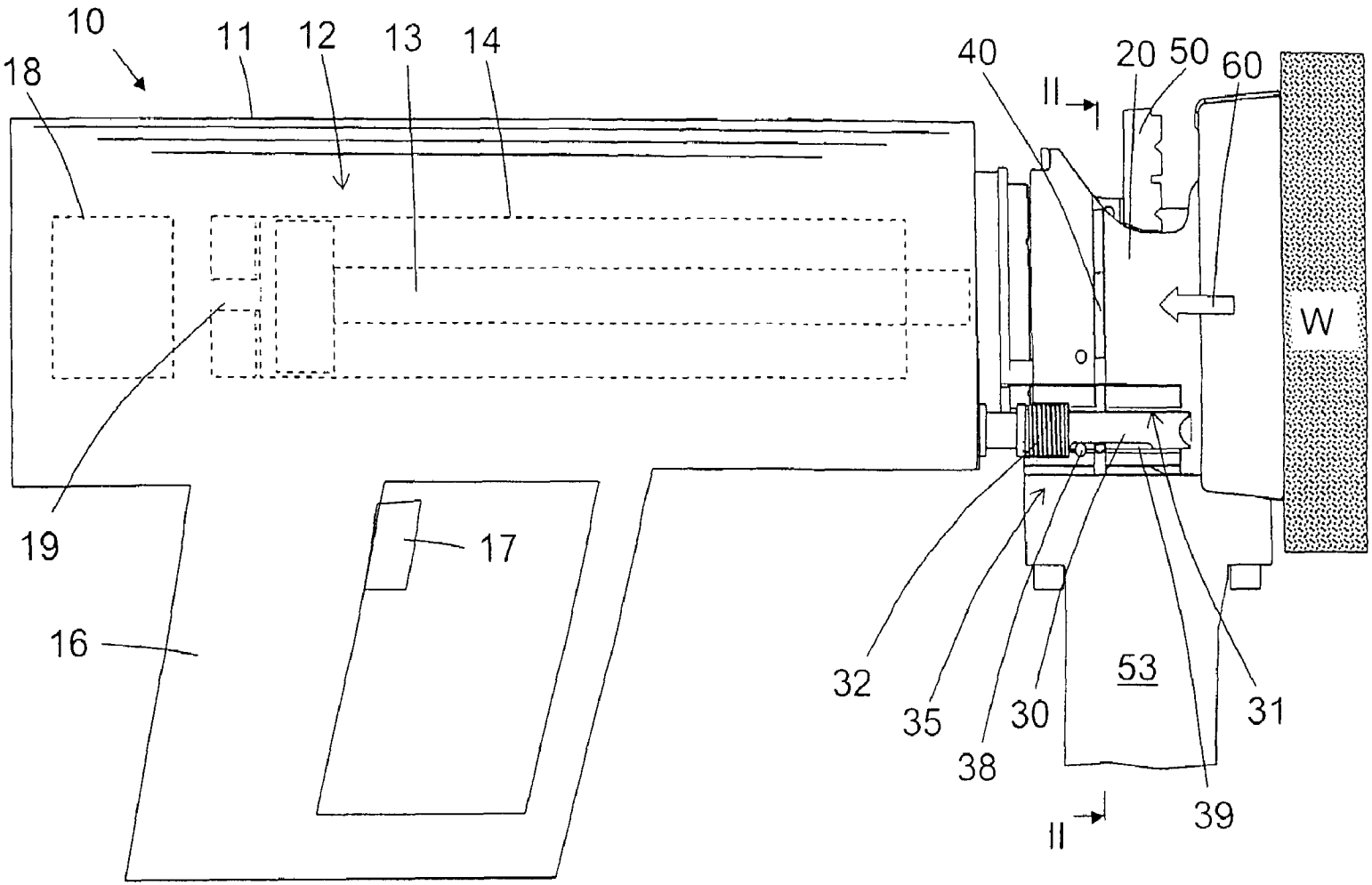
FIG. 1 a side view of a setting tool according to the present invention in a condition in which the tool is pressed against a workpiece.

FIGS. 1 through 5 show an example of a combustion power-operated hand-held setting tool 10 with a magazine 53 with fastening elements. The setting tool 10 has a setting mechanism 12 which is located in one-or multi-part housing 11 and includes a setting piston 13 displaceable in a piston guide 14 for driving fastening elements 51 in a workpiece W shown in FIG. 1 with hatched lines. The setting mechanism 12, together with the piston guide 14, define an operational axis A of the setting tool 10. For actuation of a setting process, provided, on the handle 16 of the setting tool 10, an actuation switch 17. The switch 17 actuates an ignition unit 18 for a propellant fed into a cartridge socket 19 of the setting mechanism 12.

On the setting tool 10, there is provided a muzzle member 20 that adjoins an end of the setting mechanism 12 as particularly shown in FIG. 1. The muzzle member 20 is axially displaceable relative to the housing 11 in a direction of the operational axis A and is connected, e.g., by screw means (not shown in the drawings) with the piston guide 14. In the muzzle member 20, there is provided a receiving chamber 29 that is located along the operational axis in the displacement path of the setting piston 13. Generally, only one fastening element 51, which is located in the receiving chamber 29, is engaged by the setting piston 13 of the setting mechanism 12 and is driven by the setting piston 13 in the workpiece W. Fastening elements 51 are fed into the receiving chamber 29 through a feeding channel 28 opening formed into the receiving chamber 29.

The fastening elements 51 are combined, e.g., in a fastening element strip 50 insertable into the feeding channel 28, with the fastening elements 51 being arranged on a carrier element. The fastening element strip 50 can be fed to the muzzle member 20 from a magazine of fastening elements 53 connectable with the muzzle member 20 and in which the fastening element strips 50 are resiliently biased in a transportation direction 52 by a spring-biased transportation slide 54.

On the muzzle member 20, there is provided a locking member 40 that is formed as a pivotal lever. The locking member 40 serves for detection of a fastening element 51 in the receiving chamber 29 of the muzzle member 20 and for preventing transportation of a fastening element strip 50, which is located in the feeding channel 28 of the muzzle member 20, when the setting tool 10 is pressed against the workpiece W. The locking member 40 is pivotally supported at a support point 43, with a pivot axis, which is defined by the support point 43, extending parallel to the operational axis A. A locking section 42, which is provided on the locking member 40, pivots into the feeding channel 28, with the locking member 40 being elastically biased by spring means 47 in a direction of a pivotal position of the locking section 42 in the feeding channel 28. The locking section 42 is tongue-shaped and senses the fastening element 51 that follows, in the transportation direction 52, the fastening element 51 already located in the receiving chamber 29. In a non-press-on condition of the setting tool 10, transportation of the fastening element strip 50 by the transportation slide 54 in the transportation direction 52 is possible despite bearing of the locking section 42 against a fastening element 51. The transportation is possible because the force of a spring or springs that act on the transportation slide 54 is greater than the force with which the locking section 42 holds the fastening element 51 or the fastening element strip 50.

On the setting tool 10, there is further provided a press-on feeler 30 formed as a pin and displaceable parallel to the operational axis A. The press-on feeler 30 is displaced axially within a guide space 31 formed in the muzzle member 20 and is held there, without a possibility of being lost, by a safety element 38, e.g., a locking pin. For the safety element 38, there is provided, on the press-on feeler 30, a guide 39 that defines a maximum displacement path of the press-on feeler 30 into the guide space 31 and out from the guide space 31. The press-on feeler 30 is elastically biased in a direction of a release position 33 (see FIGS. 4-5) by a spring 32 that is supported, on one hand, against an abutment 36 provided on the press-on feeler 30 and, on the other hand, against a step 26 in the guide space 31. On the housing 11, there is formed a stop 15 for the press-on feeler 30 and that limits the displacement path of the muzzle member 20 relative to the housing 11.

Figure 2:
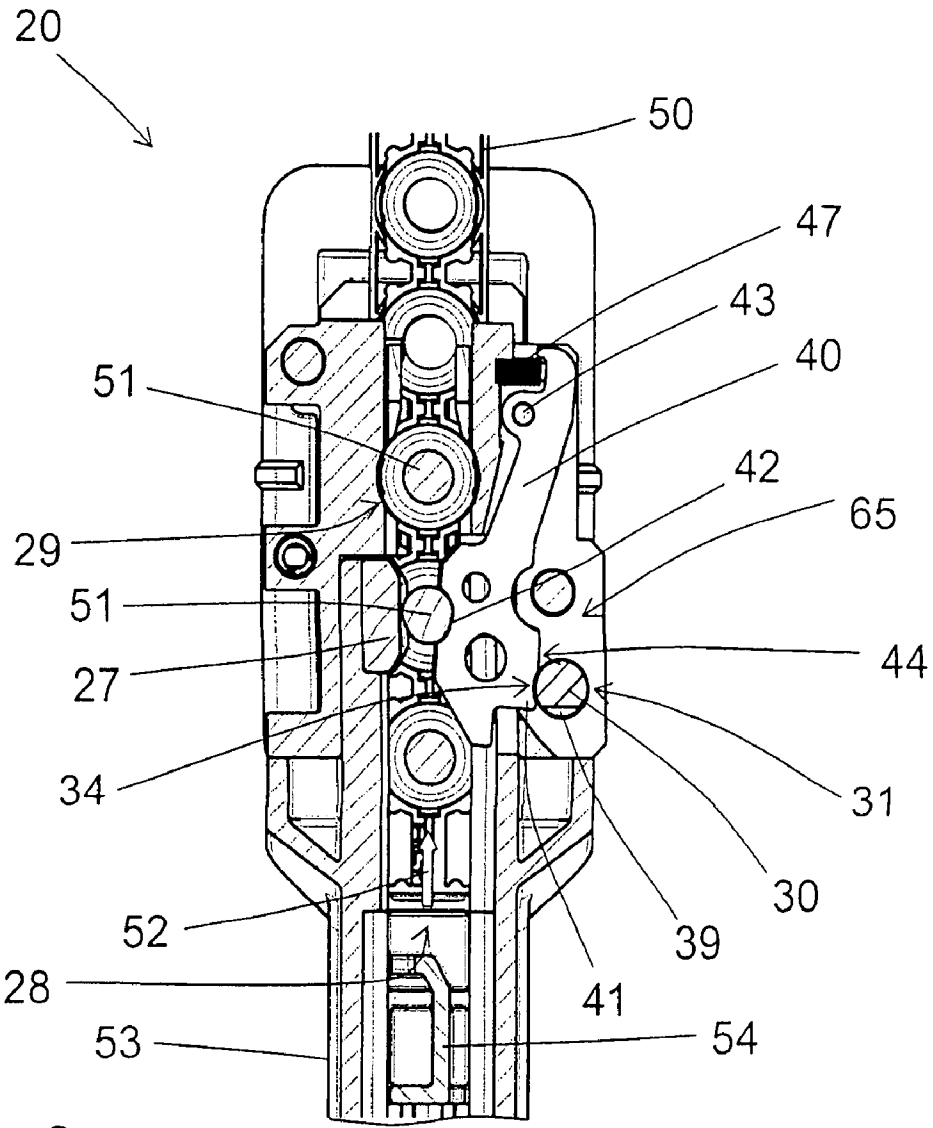
FIG. 2 cross-sectional view of the setting tool shown in FIG. 1 along line II-II in FIG. 1.

When the setting tool 10 is pressed against the workpiece W, as shown in FIG. 1, the muzzle member 20 is displaced by a distance in the direction of arrow 60 in the housing 11, whereby the press-on feeler 30 is displaced, by compressing the spring 32, into its engaged position 35 in the guide space 31. As shown in FIG. 2, with the locking profile 34 of the press-on filler 30 engaging the counter-locking profile 44 of the locking member 40, the pivotal movement of the locking member 40 out of the guide channel 28 is blocked by the press-on filler 30 in its engaged position 35. The locking member 40 occupies its displacement hold-up position 65 in which displacement of the fastening element strip 50 is prevented as a result of the locking section 42 of the locking member 40 now fixedly engaging the fastening element 51 or the fastening element strip 50. In order to prevent a sidewise displacement of the fastening element strip 51, there is provided, on a side of the guide channel 28 opposite the locking section 42, a support profile 27 against which the fastening element strip 50 or the fastening element 51 is supported.

In case of bouncing of the setting piston 13, feeding of a further fastening element 51 in the receiving space 29 is reliably prevented. Alternatively to the above-described locking section 42, the locking section can so be formed that it engages recesses formed in the carrier member of the fastening element strip 50 and not the fastening element itself.

Figure 4:
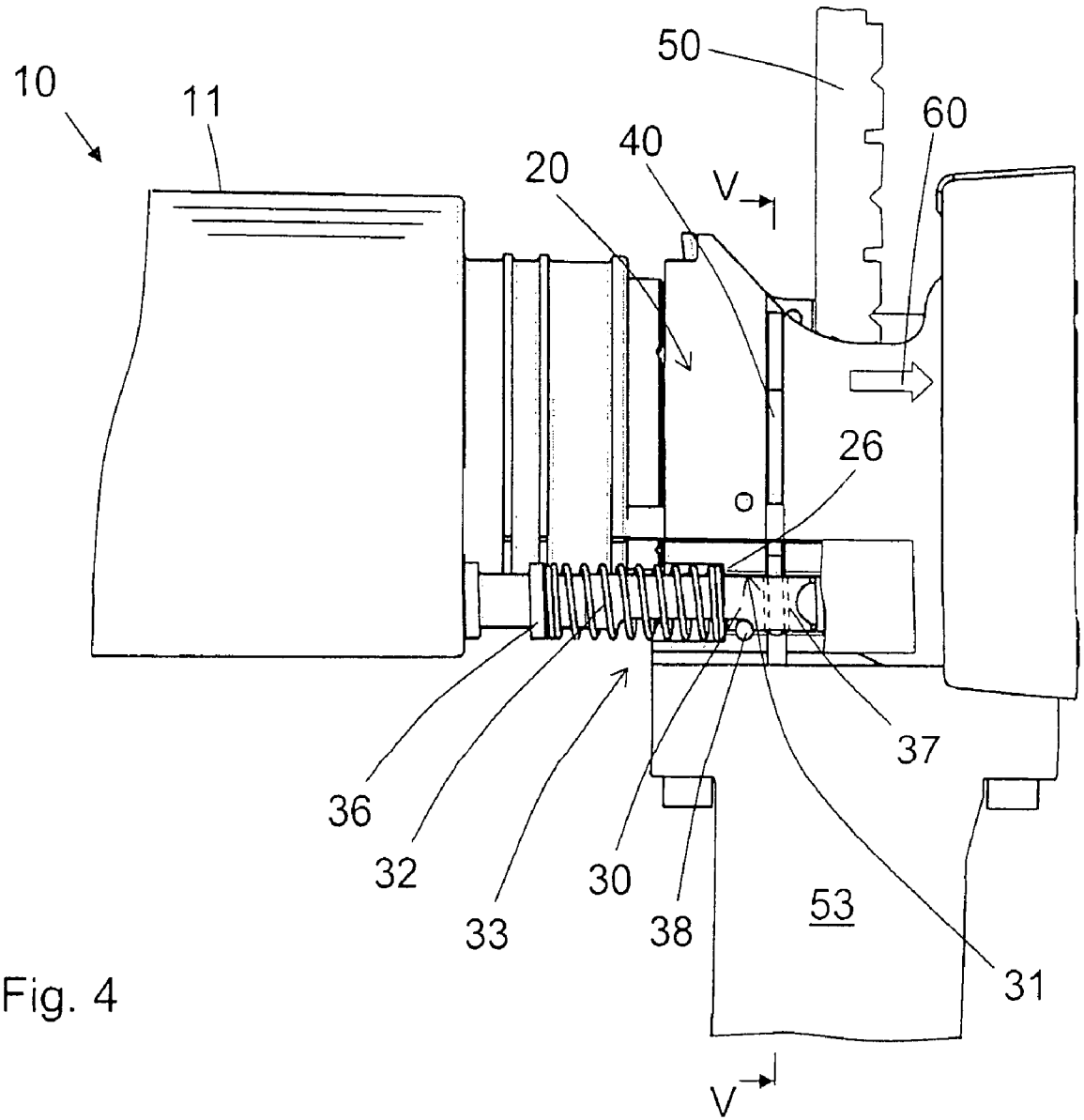
FIG. 4 a cut-out side view of a setting tool according to the present invention in a condition in which the tool is not pressed against a workpiece.

After the setting tool 10 has been lifted off the workpiece W, the muzzle member 20 is displaced away from the housing 11 in direction of arrow 62 (see FIG. 4). This displacement is produced by the press-on feeler 30 which, upon lifting of the setting tool off; is displaced by the biasing force of the spring 32 out of the guide space 31 into its release position 33. In the release position of the press-on feeler 30, the locking member 40 is not blocked anymore by the locking profile 34 of the press-on feeler 30 and can be pivoted with its locking section 41 in a recess 37 on the press-on feeler 30 in order to enable transportation of the fastening element strip 50 by the transportation slide 52.

Figure 3:
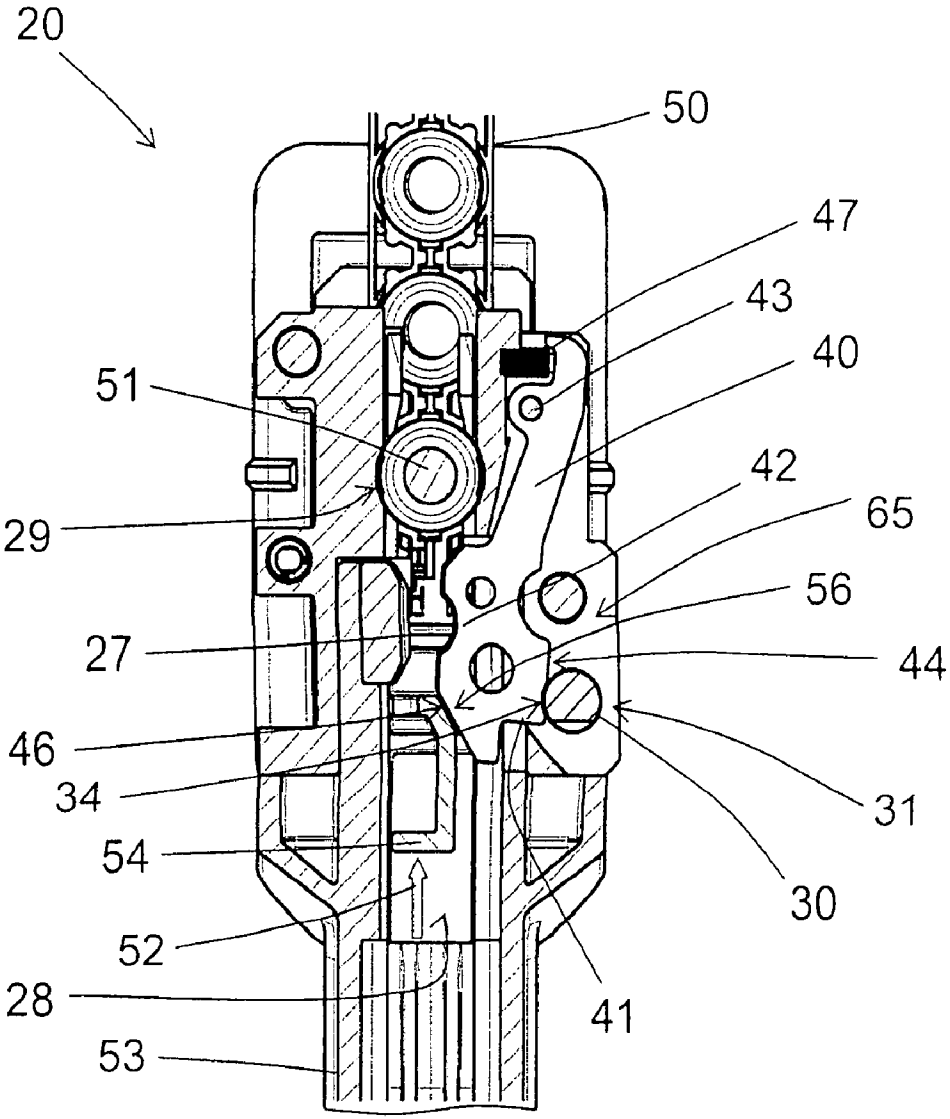
FIG. 3 a cross-sectional view similar to that of FIG. 2 with a last fastening element in the receiving chamber of the muzzle member.

In FIG. 3, the last fastening element 51 of a fastening element strip 50 has been displaced in the receiving space 29, and the setting tool 10 is again pressed against the workpiece W. The locking member 40 abuts, with its counter-inclination 45, which is formed as a rim inclined to the longitudinal extension of the guide channel 28, a corresponding inclination 56 on the transportation slide 54, preventing the transportation slide 54 from further transporting the fastening element strip 50 after completion of the setting process before the setting tool 10 is lifted off the workpiece W. In this position likewise, the locking member 40 is blocked by the locking profile 34 of the press-on feeler 30 engaging the counter-profile 44 of the locking member 40.

Figure 5:
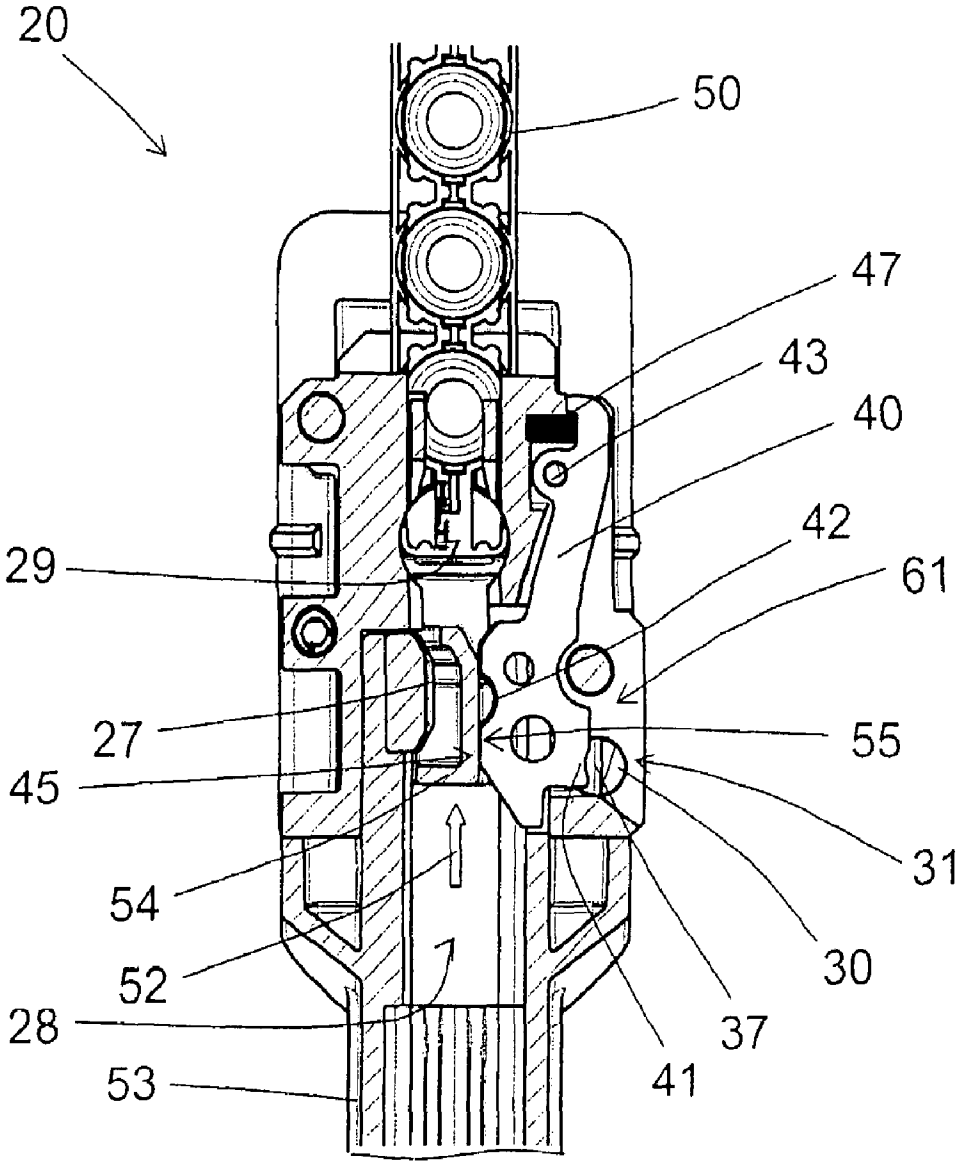
FIG. 5 a cross-sectional view along line V-V in FIG. 4 with a fastening element strip moving out of the feed channel.

In FIG. 4, the setting tool 10 is again lifted off the workpiece W after the last fastening element 51 has been set. At that, the muzzle member 20 is displaced away from the housing 11 in the direction of arrow 62, as it has already been discussed above. As shown in FIG. 5, the transportation slide 54 is again displaced a distance in the transportation direction 52, with the transportation slide 54, being substantially displaced out of the feeding channel 28 by cooperation of its inclination 56 with the counter-inclination 46 on the locking member 40. The fastening element strip 50, now without a single fastening element 51 is displaced in its removal position and can be removed from the setting tool 10. The transportation slide 54 abuts, with its adjusting profile 55 the second counter-profile 45 of the locking member 40 holding it in a press-on blocking position 61. In the blocking position 61, blocking section 41 of the locking member 40 engages in the recess 37 of the press-on feeler 30. The press-on feeler 30 is secured in its release position 33 until a new fastening element strip 50 is placed in the fastening element magazine 53 and is fed to the guide channel 28.

Thus, the inventive locking member 40 combines in a simple manner the functions of the displacement hold-up and of defection of a fastening element strip 50 in the feeding channel 28, forming both the locking section 42 and the blocking section 41.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A hand-held setting tool for driving fastening elements in, comprising:

a housing (11);

a muzzle member (20) axially displaceable relative to the housing (11) in a direction of an operational axis (A) of the setting tool (10) and having a chamber (29) for receiving a fastening element (51);

a feeding channel (28) for a fastening element strip (50) and arranged in the muzzle member (20) and opening into the receiving chamber (29);

a locking member (40) arranged on the muzzle member (20) and forming a locking section (42) displaceable into the feeding channel (28), and a blocking section (41) for preventing displacement of the muzzle member (20) relative to the housing (11); and a fastening element magazine (53) projecting from the muzzle member (20) and from which the fastening element strip (50) is fed into the feeding channel (28), wherein the fastening element magazine (53) has an elastically biased, displaceable transportation slide (54) having an adjusting profile (55) that is brought in abutment with a counter-profile (45) on the locking member (40) for displacing the locking member (40) in a position in which the locking member (40) prevents the displacement of the muzzle member (20) relative to the housing (11) when no fastening element strip (50) is located in the feeding channel (28).

2. A setting tool according to claim 1, further comprising:

a press-on feeler (30) axially displaceable in a guide space (31) provided in the muzzle member (20); and a spring (32) for resiliently biasing the press-on feeler (30) in a direction of a release position thereof out of the guide space (31), and wherein the blocking section (41) of the locking member (40) is lockingly displaceable in the guide space (31) for the press-on feeler (30).

3. A setting tool according to claim 2, wherein the press-on feeler (30) has a locking profile (34) that provides for locking of the locking member (40).

4. A setting tool according to claim 1, wherein the blocking section (41) is formed on a side of the locking member (40) remote from the feeding channel (28).

5. A setting tool according to claim 1, further comprising spring means (47) for elastically biasing the locking member (40) in a direction of an engagement position of the locking section (42) in the guide channel (28).

6. A setting tool according to claim 1, wherein a support profile (27) for the fastening element, strip (50) that projects into the feeding channel (28) is provided on a side of the feeding channel (28) opposite the locking section (42) of the locking member (40).

7. A setting tool according to claim 1, wherein the locking member (40) is formed as a pivotal lever.

8. A hand-held setting tool for driving fastening elements in, comprising:

a housing;

a muzzle member axially displaceable relative to the housing in a direction of an operational axis of the setting tool and having a chamber for receiving a fastening element;

a feeding channel for a fastening element strip and arranged in the muzzle member and opening into the receiving chamber;

a locking member arranged on the muzzle member and including, as a single element formed integrally together on the locking member:

a locking section displaceable into the feeding channel, and a blocking section for preventing displacement of the muzzle member relative to the housing; and a fastening element magazine projecting from the muzzle member and from which the fastening element strip is fed into the feeding channel, wherein the fastening element magazine has an elastically biased, displaceable transportation slide having an adjusting profile that is brought in abutment with a counter-profile on the locking member for displacing the locking member in a position in which the locking member prevents the displacement of the muzzle member relative to the housing when no fastening element strip is located in the feeding channel.

9. A setting tool according to claim 8, further comprising:

a press-on feeler axially displaceable in a guide space provided in the muzzle member; and a spring for resiliently biasing the press-on feeler in a direction of a release position thereof out of the guide space, and wherein the blocking section of the locking member is lockingly displaceable in the guide space for the press-on feeler.

10. A setting tool according to claim 9, wherein the press-on feeler has a locking profile that provides for locking of the locking member.

11. A setting tool according to claim 8, wherein the blocking section is formed on a side of the locking member remote from the feeding channel.

12. A setting tool according to claim 8, further comprising spring means for elastically biasing the locking member in a direction of an engagement position of the locking section in the guide channel.

13. A setting tool according to claim 8, wherein a support profile for the fastening element, strip that projects into the feeding channel is provided on a side of the feeding channel opposite the locking section of the locking member.

14. A setting tool according to claim 8, wherein the locking member is formed as a pivotal lever.

* * * * *